United States Patent [19]

Jackson

[11] 4,103,397

[45] Aug. 1, 1978

[54] LINT SLIDE GRID HUMIDIFIER

[76] Inventor: Samuel G. Jackson, P.O. Box 16587, Lubbock, Tex. 79490

[21] Appl. No.: 758,698

[22] Filed: Jan. 3, 1977

[51] Int. Cl.[2] ..... D01B 1/04

[52] U.S. Cl. ..... 19/66 CC; 100/74; 100/73-75

[58] Field of Search ..... 19/39, 66 R, 66 CC; 193/11, 38; 68/43, 181 R

[56] References Cited

U.S. PATENT DOCUMENTS

| | | | |
|---|---|---|---|
| 5,274 | 9/1847 | Mason | 19/66 R |
| 1,542,180 | 6/1925 | Selden et al. | 19/66 R |
| 2,665,189 | 1/1954 | Cox | 19/66 R X |
| 2,687,689 | 8/1954 | Waddle et al. | 100/74 X |
| 2,914,809 | 12/1959 | Byzick, Jr. | 19/66 CC |
| 3,114,938 | 12/1963 | Bryant | 19/66 CC |
| 3,324,513 | 6/1967 | Hurdt | 19/66 CC |
| 3,881,222 | 5/1975 | Roberson | 19/66 R |
| 4,006,679 | 2/1977 | Egosi | 100/74 X |

*Primary Examiner*—Dorsey Newton

*Attorney, Agent, or Firm*—Clarence A. O'Brien; Harvey B. Jacobson

[57] ABSTRACT

Apparatus for humidifying lint cotton in a cotton gin has a lint slide arranged for receiving a batt of cotton from a battery condenser and controlling movement of the batt over a grid made of longitudinally disposed tubular members placed inside the lint slide. Warm humit air introduced through the floor of the lint slide passes upwardly through the grid and, thus, through the cotton, and escapes into the ambient air after raising the moisture content of the cotton. A retarder device is provided on the slide for holding the cotton on the grid for longer exposure times, while the entire operation of the apparatus is controlled responsively to the action of the battery condenser of the gin.

6 Claims, 11 Drawing Figures

LINT SLIDE GRID HUMIDIFIER

BACKGROUND OF THE INVENTION

1. Field of the Invention

This invention relates generally to the humidification of fibers, specifically cotton fibers in the form of lint, prior to baling of the cotton fibers at a cotton gin, and particularly to humidification by exposure of the cotton to warm humid air.

2. Description of the Prior Art

For years the desirability of humidifying cotton prior to baling it at the cotton gin has been recognized, and many attempts have been made to accomplish this end. There are several reasons for such humidification. Dry cotton is more difficult to press into a bale than is cotton of normal moisture content. This is particularly true now that cotton gins are producing the higher density "universal density" bales. After baling, dry cotton often breaks the steel straps which contain the bale, necessitating additional laber to replace such broken straps.

Probably the first systematic method of humidifying at the lint slide ahead of the baling press in a cotton gin was that of spraying the batt of cotton with a fine mist of liquid water to which a wetting agent had been added. This method was developed by the U.S. Government's Cotton Ginning Laboratory, at Stoneville, Mississippi, and was described by Charles A. Bennett in his article "Engineering Progress in Cotton Ginning" which appeared in the *Cotton and Cotton Oil Press* of Mar. 22, 1947. Apparatus employing this method is disclosed in U.S. Pat. No. 3,324,513, issued June 13, 1967, to D. B. Hurdt.

It has been common practice over the years to apply steam to the cotton at various points in a cotton ginning process. This method was especially popular when cotton gins were powered by steam engines and steam was readily available for this purpose. An example of steam humidification is described in U.S. Pat. No. 2,019,079, issued Oct. 29, 1935, to C. S. Herring.

At the present time, the most popular method of humidifying cotton at the gin involves exposing the cotton to warm humid air. This conditioning air is commonly generated by a device manufactured by the Samuel Jackson Manufacturing Corporation under the trademark "Humidaire", the corporation being controlled by the applicant herein. Such a unit comprises a direct-fired air heater, in which a gas fired burner operates with an open flame in the stream of air to be humidified. The stream of air is subsequently subjected to an air washer in which a recirculated water spray scrubs the heated air, simultaneously cooling the air and evaporating the water. The result is a supply of warm humid air of about 40° to 60° C dry bulb temperature and 70 to 100% relative humidity.

The humid air generated by the aforementioned humidifying unit has been applied in the feeders over the gin stands, in the conveyer distributor, in conditioning hoppers disposed between the conveyor distributor and the feeders, and in tower dryers. All the foregoing applications have as their object either the klling of state electricity or the lessening of damage to the cotton fibers during the ginning and lint cleaning processes. U.S. Pat. No. 2,312,557, issued Mar. 2,1943, to R. M. Joyce, discloses a method wherein cotton fibers are subjected to moist air conveyed into the stream of cotton in the lint flue as the stream of cotton emerges from the gin and prior to forming of the fibers into a batt of cotton.

In recent years, humid air has also been applied in the battery condenser of a cotton gin just ahead of the doffing rollers with the object of increasing the moisture content of the cotton fibers just prior to baling the ginned lint. See, for example, U.S. Pat. No. 2,815,536, issued Dec. 10, 1957, to W. R. Bryant. While this method accomplishes the purpose for which it is intended, it has certain disadvantages. In cold weather, moisture will sometimes condense on the condenser screen and cause it to "hair over" with a layer of cotton fibers which cannot be removed by the doffing rollers. Where the operation of the condenser is marginal, the introduction of additional air has also caused problems with forming a proper batt.

To avoid these difficulties, others have enclosed the lint slide down which the lint passes after leaving the battery condenser and introduced humid air through the lint slide cover. The humid air passes over the top of the cotton and exits through a screened opening elsewhere in the cover. Since it is difficult to make the humid air penetrate down into the cotton, this method has not found extensive use or success, except to maintain the moisture level achieved by humidification of the condenser.

Some years ago, I tried to humidify cotton by providing a small grid in the bottom of the lint slide, but the attempt was unsuccessful. The area of the grid was much too small and any significant flow of air blew the cotton out of the slide, with the result that it was impossible to raise the moisture content of the cotton by a measurable amount.

SUMMARY OF THE INVENTION

It is an object of the present invention to humidify ginned cotton before baling it without affecting the operation of the battery condenser of the gin and without the problems inherent in spraying liquid water on the cotton.

It is another object of the invention to provide an arrangement for reducing the pressing force necessary to bale cotton.

It is yet another object of the present invention to reduce the incidence of broken cotton bale ties.

These and other objects are achieved according to the present invention by providing apparatus having: a conveyer for receiving a mat of material and controlling the movement of the mat along a path of travel between a pair of work stations in a processing plant; and an exchanger disposed on the lint conveyor in the path of travel of the mat of material for subjecting the material to a treating fluid. More specifically, the exchanger includes a grid arranged on the lint conveyer for forming part of the path of travel of the material. Preferably, a diffuser is arranged on the lint conveyer beneath the grid for passing the fluid through the grid in a predetermined diffused manner.

The lint conveyer is advantageously a substantially planar, downwardly inclined slide, having a longitudinal extent and a predetermined width. The grid includes a plurality of tubular members disposed extending longitudinally of the extent of and spaced from the slide across substantially the entire width of the slide.

The diffuser arrangement includes a transition arranged receiving the treating fluid for spreading and reducing the velocity of the fluid, with a diffuser plate being arranged receiving the fluid from the transition in order to thoroughly diffuse the fluid beneath the grid.

The present invention also includes a retarder device provided on the lint conveyor for holding the material being treated on the grid of the exchanger for a variable period of exposure to the fluid. This retarder device can incorporate one or more fingers arranged biasing against the material being treated, with an actuator assembly mounted on the slide holding the finger or fingers against the material with a predetermined force. In this manner, the flow of material will be held up until the force of material on the finger or fingers exceeds the predetermined force so as to release the finger or fingers at such time and permit the material to continue flowing down the lint conveyer.

The invention also provides for control of both the retarder device and the flow of fluid through the grid as a function of a pressure differential across a screen associated with the battery condenser feeding the mat of material to the lint conveyer.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
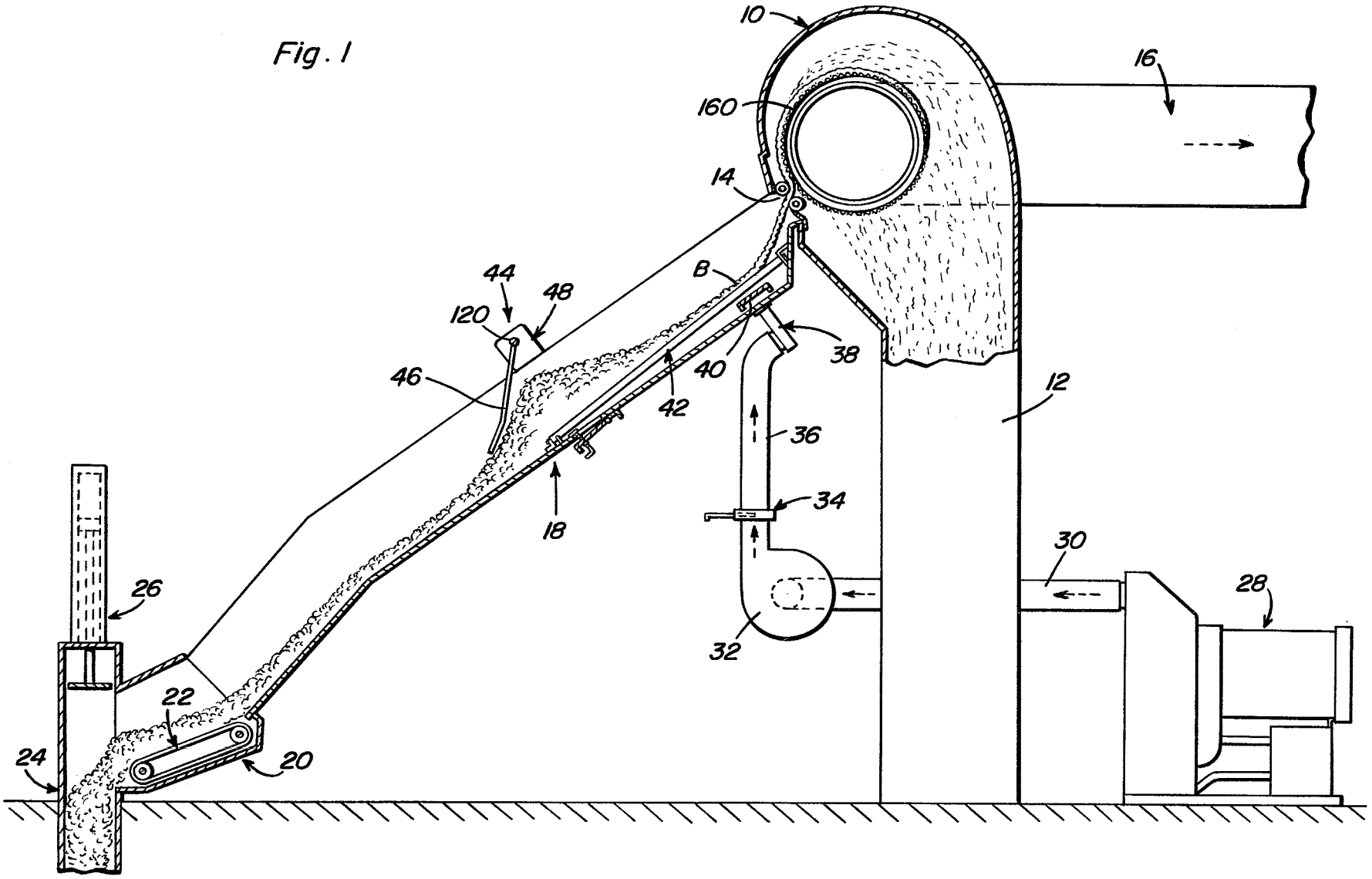
FIG. 1 is a fragmentary, schematic, side elevational view, partly cut away and in vertical section, showing a portion of a ginning plant provided with apparatus according to the present invention.

Referring first more particularly to FIG. 1 of the drawings, within a cotton gin plant, a battery condenser 10 of generally conventional construction receives ginned cotton conveyed by air through a lint flue 12 and discharges the cotton at a point 14 in the form of a batt B. The carrying air leaves the condenser 10 through an exhaust duct 16, while the batt B is discharged onto a lint slide 18. The latter conducts the cotton batt B downward into a lint charger 20 which may take several forms, but is illustrated as being of the conventional construction employing a belt conveyer 22 to deliver the ginned cotton into a press box 24 where it is compacted by a tramper 26 for baling in the conventional manner.

A source of warm humid air in the form of a humidifying unit 28 delivers air through the conduit 30 into the intake of a fan 32. The latter blows the treated air through an adjustable gate valve 34 and into a conducting pipe 36 to an air inlet transition 38 which spreads the air and introduces it to the bottom of the lint slide 18. The introduced air passes upward past a diffuser 40 and subsequently through a grid 42 disposed in the lint slide 18. In this manner, the air passes through the batt B of cotton which is passing over the top of the grid 42 and then escapes into the atmosphere surrounding the apparatus. A retarding device 44 having fingers 46 and an actuator 48 is mounted on lint slide 18 so as to hold the cotton on grid 42 for a longer exposure as such is desired.

Figure 2:
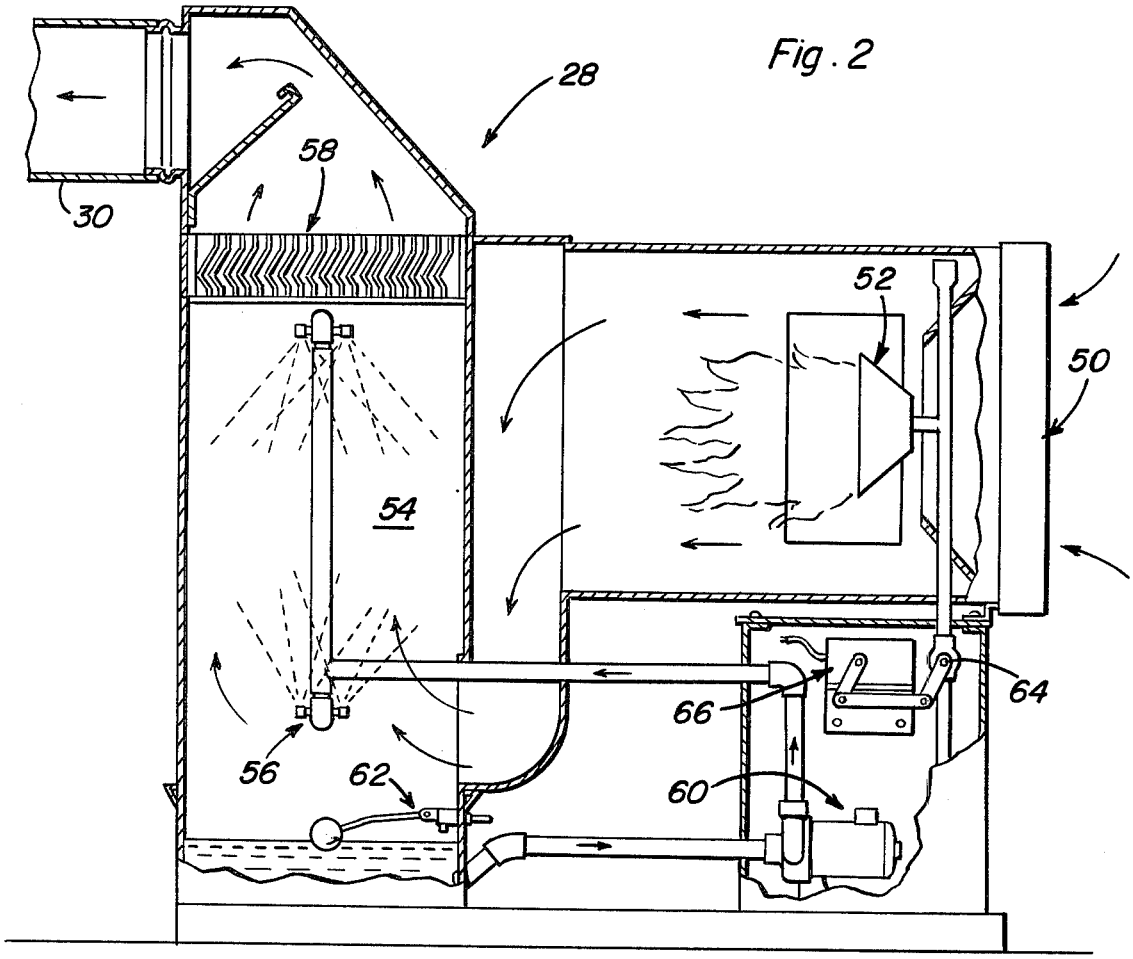
FIG. 2 is an enlarged, schematic, side elevational view, partly cut away and in vertical section, showing a unit which supplies humid air for use with the present invention.

Referring now more particularly to FIG. 2 of the drawings, the humidifying unit 28 will now be described. This unit is commercially available from the Samuel Jackson Manufacturing Corporation under the designation "HU-60 Humidaire Unit", and includes screened air inlet 50 which permits air to be humidified by unit 28 to enter thereinto. Air entering through the screened air inlet 50 passes through and around a direct-fired gas burner 52 and subsequently enters the bottom of a spray chamber 54 of unit 28. This spray chamber 54 is filled with water droplets sprayed by the nozzles 56. The hot air, having been cooled and humified by the water spray, passes upwardly through zig-zag mist eliminators 58 which eliminate all the water droplets, allowing only warm, humid air to exit the unit 28. The sprayed water is continuously recycled by a motor driven pump 60 of conventional construction, with the water which is evaporated being replenished by a system including the conventional float valve 62.

It will be seen that if the pump 60 is stopped, the air delivered will be hot and dry. Such air is sometimes used for drying cotton, but in the present invention it is used for heating the grid 42 and slide 18 to prevent condensation on these assemblies during humidification of the cotton. The output of the gas burner 52 is varied by a conventional gas throttling valve 64, which valve 64 is driven by a modulating motor 66 also of conventional construction. In order to regulate the humidifying effect of the air produced by the unit 28 so as to produce the desired effect on the cotton batt B, the modulating motor 66 may be manually positioned, or it can be positioned by a control system (not shown), which is of conventional construction, but does not form part of the present invention.

Although the humidifying unit 28 has been described as a source of warm, humid air, it should be understood that any source can be substituted for unit 28 which is capable of producing, for example, 2,000 cubic feet per minute of air having the conditions of a dry bulb temperature in the range of 40° to 60° C and a relative humidity in the range of 70 to 100%.

Figures 3, 4:
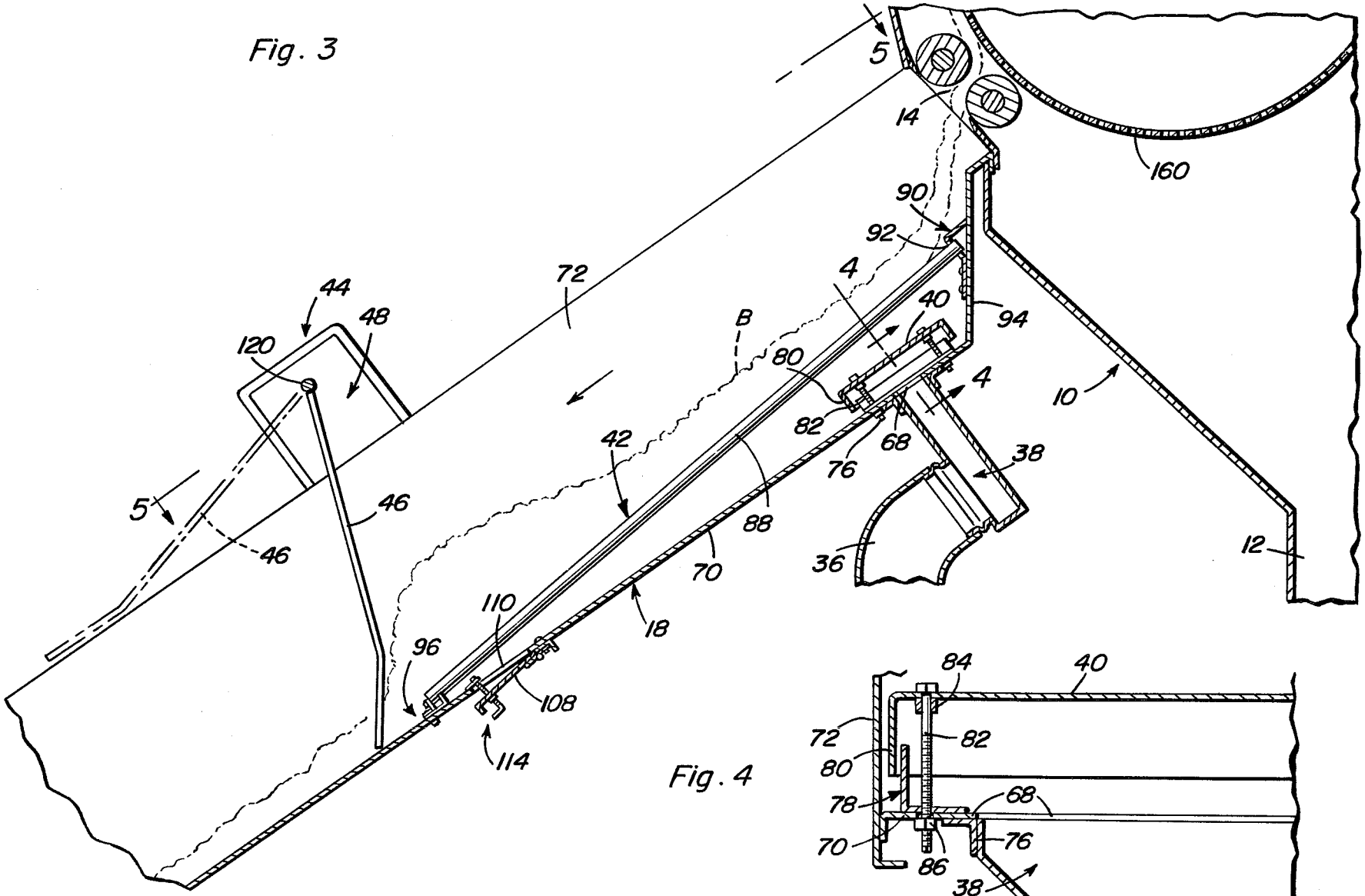
FIG. 3 is an enlarged, fragmentary, vertical sectional view showing the central portion of FIG. 1.
FIG. 4 is an enlarged, fragmentary, sectional view, taken generally along the line 4—4 of FIG. 3.
Figure 5:
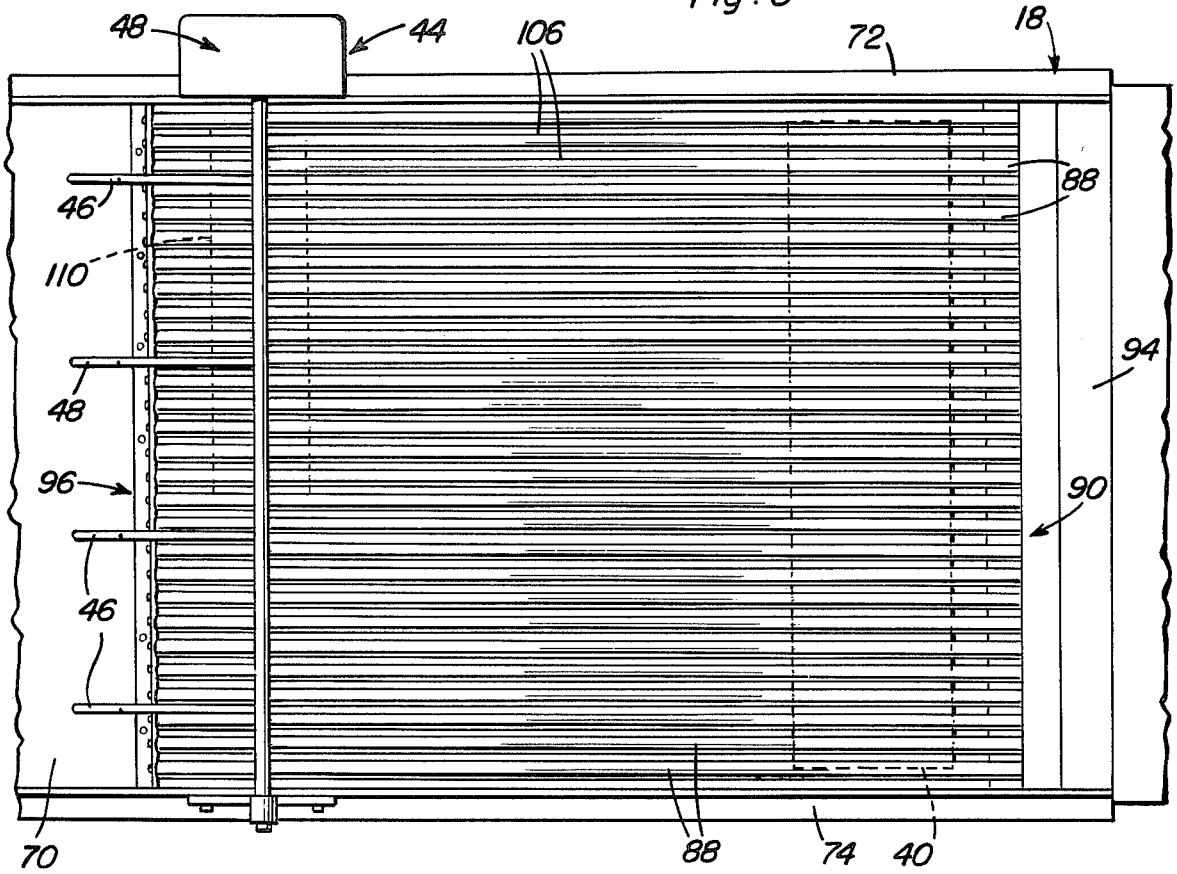
FIG. 5 is a fragmentary, top plan view looking in the direction of the arrows 5—5 of FIG. 3.

Referring now more particularly to FIGS. 3 through 5, the air inlet transition 38 receives the humid air from the humidifying unit 28, spreads it, and introduces it into a slot 68 cut in the bottom surface 70 of lint slide 18. When working with a standard ling slide, which is 54 inches wide, it has been found to be satisfactory to introduce the humid air through a slot 68 which measures, for example, four inches along the inclined longitudinal extent and 48 inches across the bottom surface 70 of slide 18.

Lint slide 18 includes in addition to the bottom surface 70 a pair of substantially parallel side walls 72 and 74 extending in spaced relation from the peripheral portions of bottom surface 70. This arrangement forms a trough which retains the cotton of batt B along its predetermined flow path as indicated by the arrow in FIG. 3 even when the batt B is being held up by the retarding device 44.

The diverging transition 38, including a fitting for connection thereof near its apex to the pipe 36, is mounted on the bottom surface 70 of slide 18 as by a pair of conventional angle brackets 78 attached to slide 18 and transition 38 in a suitable manner, such as by welding. The diffuser 40 is adjustably mounted above the slot 68, which forms an outlet opening for transition 38, as by a pair of angles 78, each interengaging with the downwardly turned flange 80 of the plate forming diffuser 40. Bolts 82 extend through holes provided in diffuser 40 and are retained relative thereto as by the illustrated collars 84, with the bolts 82 being adjustably mounted on the bottom surface 70 of slide 18 as by nuts 86 attached to surface 70. By this arrangement, diffuser 40 can be adjusted for the desired diffusion of the flow of treated air passing from transition 38 and cause the air to flow evenly under the grid 42.

Figure 6:
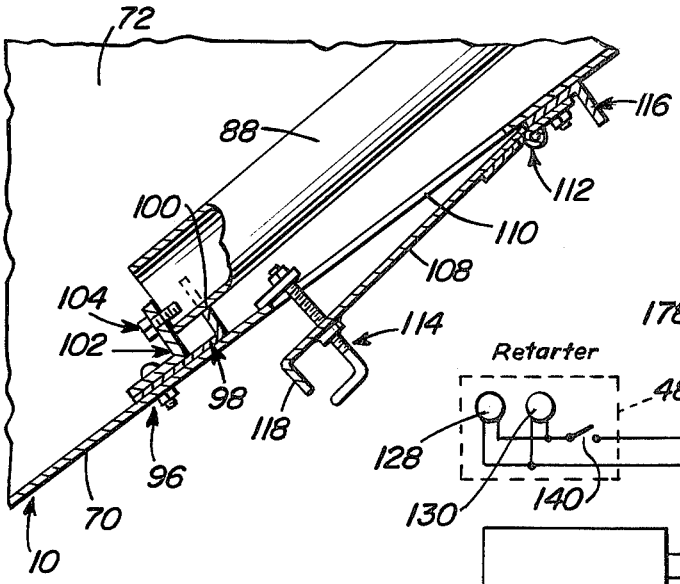
FIG. 6 is an enlarged, fragmentary, vertical sectional view showing in detail the lower portion of FIG. 3.

As can be seen from FIG. 6 taken in conjunction with FIGS. 3 and 5, the functional portion of grid 42 comprises a plurality of tubes 88 positioned longitudinally of the extent of slide 18. While the number and size of tubes 88 may vary, good results have been obtained using 27 galvanized steel tubes each 1.75 inches in diameter and 10 feet long spaced on two inch centers so there is a gap of 0.25 inches between the tubes. Tubes 88 are held in position by an upper tube support 90 in the form of a piece of sheet metal punched with an appropriate number of holes 92 to receive the tubes and then formed to the configuration seen in FIG. 3. Upper tube support 90 is bolted to the vertical portion 94 located at the upper end of slide 18. If the slide 18 has no vertical portion such as that designated 94 at this location, with the upper portion 94 being at least 12 inches high, for example, slide 18 must be modified to provide such vertical portion to allow the batt B to slide onto the top of grid 42 and provide room for the air diffuser 40.

A lower tube support 96 includes a member 98 having semicircular recesses 100 formed in its upper edge so as to cradle the lower end portions of the tubes 88 and hold them in their proper spacing. The lower ends of the tubes 88 are thrust against a further member 102 of lower tube support 96, which arrangement keeps the tubes 88 from coming out of the holes 92 provided in the upper tube support 90. Cap screws 104, and the like, are provided on the member 102 in a like number as the number of tubes 88 so as to project into the bottom ends of the tubes 88 and hold them in place on the lower tube support 96. Each tube 88 can be removed from the assembly by pushing it upward into the associated hole 92 of upper tube support 90 and subsequently lifting the lower end of the tube 88 clear of its associated cap screw 104 and pulling it out of the upper tube support 90.

Although grid 42 could be made of perforated metal, and the like, or some other conventional method of construction used, its formation of tubular members, such as tubes 88, has certain advantages. Since the direction of movement of the cotton batt B is parallel to the axes of the longitudinal extent of the tubes 88, frictional resistance to sliding is minimal. This factor also explains the construction of the lower tube support 96 in which all portions of support 96 lie below the center of the tubes 88 where they cannot interfere with the passage of the cotton batt B. Another reason for the preference of the tubes 88 is that they have adequate structural rigidity to span, for example, 10 feet without an intermediate support. This allows the grid 42 to be assembled and disassembled a piece at a time without the need for hoisting a heavy assembly, whether for original assembly or for periodic maintenance of the exchanger.

Yet another reason for using round tubular members such as tubes 88 is for their effect in diffusing the air passing upwardly through the gaps 106 formed between tubes 88. If, for example, tubes 88 of square cross section were used, the air passing upwardly through the 0.25 inch gaps, for example, would exit at an average velocity equal to the volume of air passed divided by the total slot or gap area. With tubes 88 of circular cross section, this same velocity is attained in the throat of each gap 104 at the center line of the adjacent tubes 88. As the air passes this throat, the surfaces of the tubes 88 diverge giving a flow path of larger cross-sectional area, thus slowing the velocity of air so it is less likely to blow the batt B out of the lint slide 18 or to disturb it otherwise.

In order to assure that the diffused air passing from the adjustable inverted-pan-like diffuser 40 passes evenly to the lower end of tubes 88, an air vent door 108 is provided adjacent the lower tube support 96 so as to selectively block and unblock an opening 110 provided in bottom surface 70 of slide 18. This door 108 is mounted on the bottom surface 70 of slide 18 as by a hinge 112, and is adjusted relative to opening 110 as by a screw and nut latch arrangement 114. A flanged bracket 116 associated with hinge 112 acts as a brace for stiffening the portion of bottom surface 70 immediately adjacent opening 110, while a flange 118 is provided on door 108 adjacent latch arrangement 114 for likewise stiffening the adjacent edge of door 108. Bottom surface 70 is stiffened by the lower tube support 96.

In short lint slides where the lower end of the grid 42 is near the entrance to the lint charger 20, the cotton is often stacked immobile on the grid 42, since the lint slide 18 serves to store cotton between strokes of the tamper 26 and while the press is being turned to allow another box (not shown) to be filled. In longer lint slides, it has been found desirable to provide a means for retarding the downward flow of the cotton batt B to hold it on the grid 42 for a longer time in order to absorb moisture more thoroughly. Referring again to FIG. 3, the cotton retarder 44 has four fingers 46, for example, made of light steel tubing, and the like, which extend down into the lint slide 18 to form a barrier to the passage of the cotton batt B. The shaft 120 to which the fingers 46 are attached is actuated by the retarder actuator 48. As can be seen from FIGS. 7 and 8 of the drawings, which show the internal parts of the retarder actuator 48, the torque on shaft 120 is applied by the action of a pneumatic piston and cylinder assembly 122 acting through crank arm 124. The pneumatic pressure applied to the blind end of the assembly 122 determines the retarding effect, and this air pressure can be varied by means of a pressure regulator 126. When this regulated air pressure causes the fingers 46 to stop the downward flow of the cotton batt B, the cotton begins to accumulate on top of the grid 42. As more cotton accumulates, its weight exerts a greater force on the fingers 46 until it is enough to overcome the torque of shaft 120 and force the fingers 46 upward so that cotton can extrude beneath the fingers 46 and pass down the slide 18. This passage occurs until the weight of cotton above the fingers is again light enough to be restrained by the torque of shaft 120. This is a continuing stable process, with cotton batt B flowing from the condenser 10 into the restrained mass and continuously extruding beneath the fingers 46 so as to maintain a fairly constant mass of cotton restrained above the grid 42. It will be seen that increasing the setting of the pressure regulator 126 will result in restraining a larger mass of cotton above the grid 42, and decreasing the pressure in restraining a smaller mass.

It is necessary to make provisions to lift the retarding fingers 46 out of the slide 18 at certain times in order to allow the slide 18 to empty. The reasons for this are to prevent mixing one customer's cotton with another's cotton, to prevent restrained cotton from presenting a fire hazard, and to provide more storage capacity in the lint slide 18 while the press is being turned. To accomplish this, the retarding device 44 is arranged to restrain the cotton batt B only when an electrical signal is applied to it. The source of this signal will be more fully described below. The electrical signal energizes the two solenoid valves 128 and 130. When energized, valve 128 applies regulated air pressure to the blind end of assembly 122, and the valve 130 vents the rod end of this assembly 122 to atmosphere. The fingers 46 are lifted upon removal of the signal by the action of the solenoid valves 128 and 130. When deenergized, valve 128 stops the flow of regulated air and vents the blind end of assembly 122 to the atmosphere, while valve 130 applies the full unregulated air pressure to the rod end 132 of assembly 122, thus lifting the fingers 46 out of slide 18. A needle valve 134 restricts the flow of air into the rod end 132 of assembly 122 in order to make the lifting action slow and gentle. A filter and water separator 136 handles all the air applied to the actuator 48, while a lubricator 138 lubricates the air which passes to the rod end 132 of assembly 122. A toggle switch 140 can be used to permit the fingers 46 to be lifted even though the electrical signal is being applied to actuator 48.

Actuator 48 also includes a connection box 142 having provided in a lower surface thereof an aperture 14 for permitting an electrical line (not shown) to pass into the connection box 142 in order to electrically connect box 142 to the aforementioned source of a signal for controlling the operation of the retarding device 44. The construction of connection box 142 is of a conventional nature, and accordingly will not be described herein.

Figure 8:
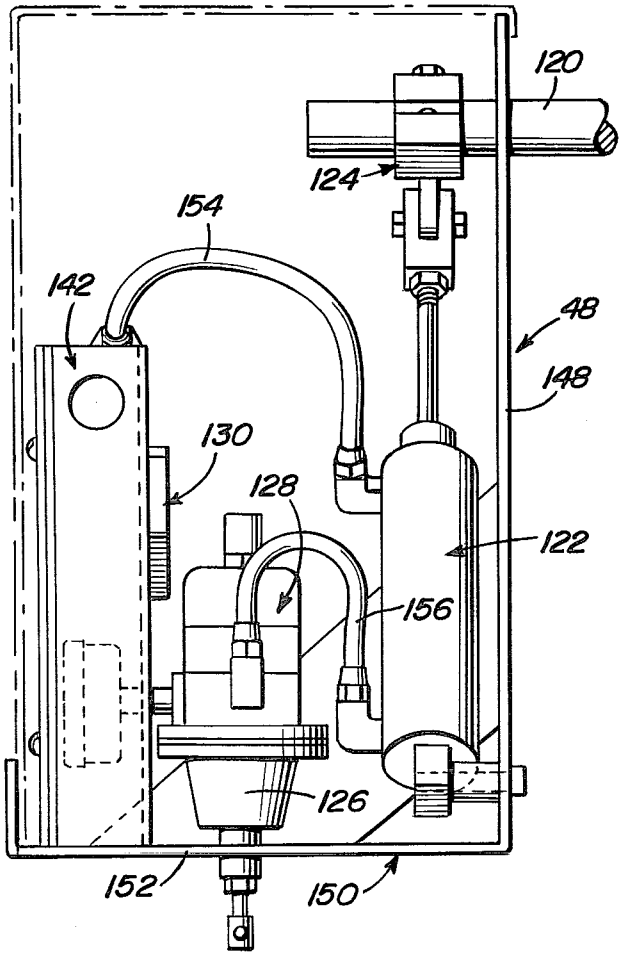
FIG. 8 is a fragmentary, end elevational view looking from the right in FIG. 7.
Figure 7:
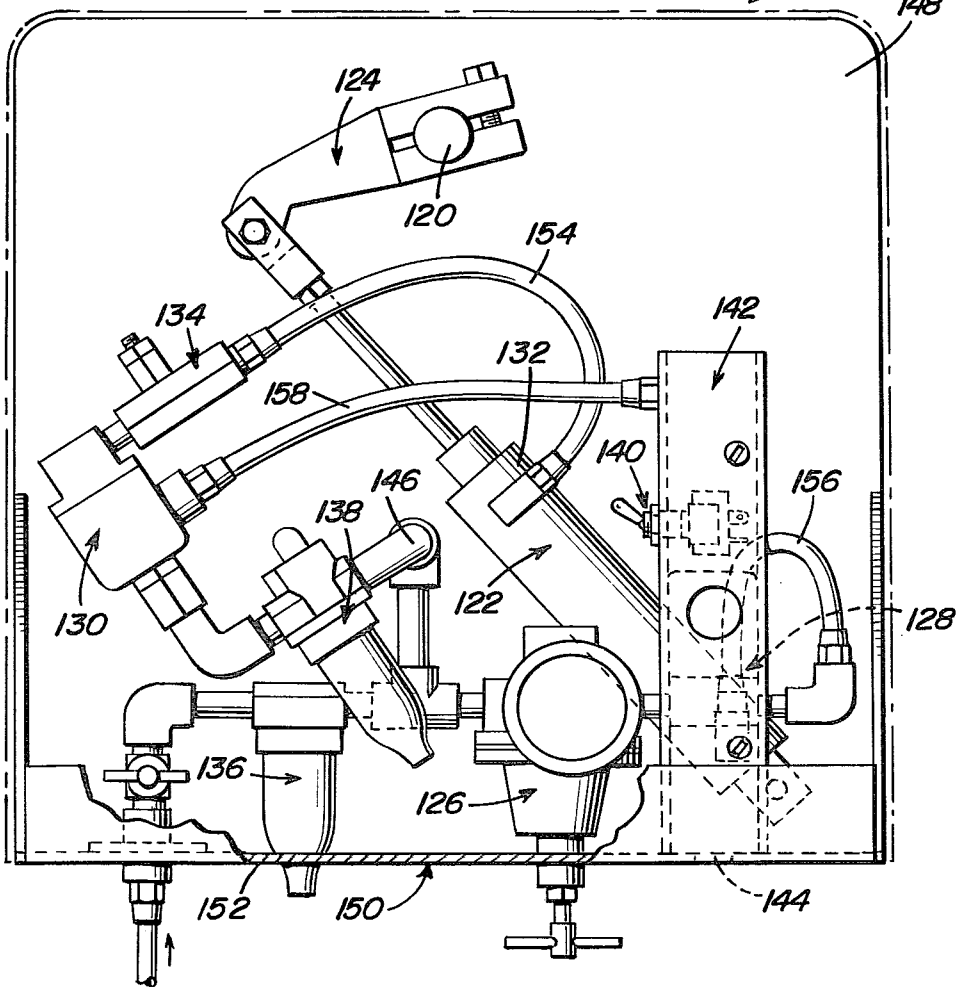
FIG. 7 is a fragmentary, side elevational view, partly cut away and in section, showing an actuator assembly for use with a retarder device according to the present invention.

The piping configuration shown in FIGS. 7 and 8 is for the regarding actuator 48 to be mounted on side wall 72 of lint slide 18 on the right hand looking down the slide 18. The piping is designed so that the solenoid valve 130 and lubricator 138 can be pivoted upwardly about a pivot axis 146 for use on the left hand side wall 74 of slide 18. In either case, the lubricator 138 will be approximately level. For left hand operation, the crank arm 124 is placed on shaft 120 so as to extend downwardly to the right as seen in FIG. 7 as opposed to the left as shown, and the bottom clevis of assembly 122 is switched to another mounting boss (not shown) on the left hand side of a mounting plate 148 which partially forms a housing 150 of actuator 48. This housing 150 also includes the base plate 152 on which the connection box 142 is mounting, and is provided with a suitable opening permitting the adjusting handle of the pressure regulator 126 to extend beneath the base plate 142 so as to be accessible from without housing 150.

A house 154 connects the needle valve 134 associated with solenoid valve 130 to the rod end 132 of the piston and cylinder assembly 122. Further, hose 156 connects the other end of the cylinder of the assembly 122. referred to as the blind end, to a source of air, and the like, under pressure being received from the regulator 126 and the separator 136. The air under pressure enters housing 150 in the direction of the flow arrow in FIG. 7 by means of a conventional fitting and on-off valve. A flexible conduit 158 is shown as extending between the solenoid valve 130 and the connection box 142 as a means of transmitting an electrical signal between connection box 142 to the solenoid valve 130 for purposes of controlling the operation of valve 130. It will be understood that a similar connection is made from box 142 to the solenoid valve 128 in a manner not shown.

Figure 9:
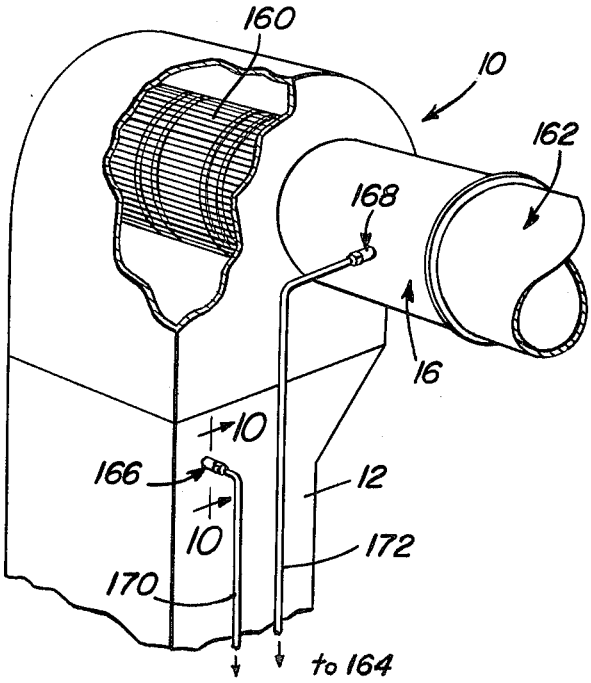
FIG. 9 is a fragmentary, perspective view, partly cut away and in section, showing a battery condenser used with the present invention.
Figure 10:
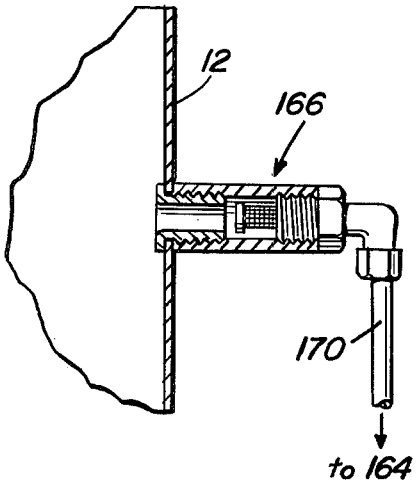
FIG. 10 is an enlarged, fragmentary, sectional view taken generally along the line 10—10 of FIG. 9.
Figure 11:
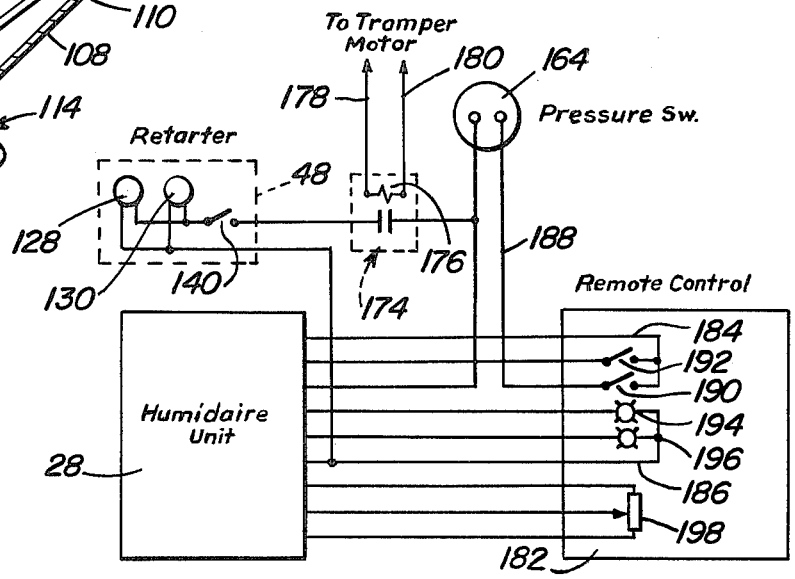
FIG. 11 is a schematic diagram showing an electrical circuit used for controlling lint humidifying apparatus according to the present invention.

The electrical signal which raises and lowers the fingers 46 is produced when the battery condenser 10 is producing a batt B and the tramper 26 is operating. Referring to FIGS. 9 through 11, the battery condenser 10 has provided therein a rotating screen 160 of generally cylindrical form on which the cotton batt B is produced. The air-borne lint enters the condenser 10 through the lint flue 12. Air is withdrawn from inside the condenser screen 160 through the exhaust duct 16 by an exhaust fan 162. When no batt B is being produced, no cotton is on the screen 160 and the differential pressure between the lint flue 12 and the exhaust duct 16 is almost zero. When a batt B is being formed on the screen 160, the flow of air is impeded and the differential pressure across the screen 160 becomes sufficient to operate a differential pressure switch 164. A pressure differential of $1\frac{1}{2}$ to 3 inches of water has been found in typical condenser installations. The differential pressure switch 164, which is of conventional construction, has a diaphragm (not shown), the two sides of which are connected to pressure taps 166 and 168 disposed in the lint flue 12 and the exhaust duct 16, respectively, and connected to the pressure switch 164 as by the illustrated pneumatical lines 170 and 172. One pressure switch 164 that has been employed with good results in carrying out the present invention is Model C 645 C 1020, manufactured by Honeywell, Inc. When the differential pressure applied to the switch 164 is sufficient to overcome the force of an adjustable spring (not shown) on the diaphragm, the diaphragm moves and actuates a microswitch (not shown) disposed within switch 164. In the circuit shown in FIG. 11, the closing of this microswitch performs two functions. First, it starts the water pump 60 in the humidifying unit 28 so as to start producing humid air. Second, it provides a signal which actuates the cotton retarding device 44. A relay 174 can also be used in the illustrated circuit to insure that the fingers 46 of retarding device 44 raise when the tramper 26 is stopped. The coil 176 of relay 174 is connected to the electrical wires 178 and 180 which supply power to the motor of tramper 26. The logic of the illustrated circuit is that if cotton is passing through the battery condenser 10, the water pump 60 of the humidifying unit 28 is turned on and humid air, instead of hot preheating air, is delivered to grid 42. For the retarding device 44 to receive the signal to restrain cotton, cotton must be passing through the condenser 10 and the tramper 26 must be operating. Absence of either condition will cause the fingers 46 to raise to their inoperative position as shown in broken lines in FIG. 3.

The circuit shown in FIG. 11 includes a remote control unit 182 connected to the humidifying unit 28 and to the pressure switch 164 for controlling the humidifying unit 28 and the retarding device 44. This remote control unit is supplied with a hot lead 184 and a neutral lead 186 which permits suitable electrical power to be supplied to the circuit, and is connected by a line 188 passing through a switch 190 for placing the pressure switch 164 in electrical communication with pump 60 of humidifying unit 28. Switch 192 is connected to burner 52 of humidifying unit 28 in order to control the operation of same. Lamps 194 and 196 are associated with pump 60 and burner 52, respectively, for providing a visual indication of the energization of same.

A potentiometer 198, which is usually manually positioned to maintain the desired moisture content in the treated cotton, can be connected to the modulating motor 66 of the humidifying unit 28 in order to control the amount of fuel fed to burner 52 and consequently regulate the temperature to which the treating air is heated in humidifying unit 28.

As can be seen from FIG. 11, when the switch 140 of retarding device 44, or more specifically the connection box 142 thereof, is closed together with the switch 190 energizing the pump 60 of the humidifying unit 28, and a sufficient pressure differential exists between flue 12 and exhaust duct 16 to close pressure switch 164, energization of the motor of tramper 26 will energize coil 176 of relay 174 and cause the normally open contact of that relay to close so as to complete a circuit through the solenoid valves 128 and 130 in order to actuate the retarding device 44. There will be a pressure differential across the pressure switch 164 only if the battery condenser 10 is operating and is passing cotton batt to the lint slide 18 and its associated grid 42. Thus, the retarding device 44 can receive a signal to restrain cotton only if both condenser 10 and tramper 26 are operating, and as mentioned above, absence of either condition will cause the fingers 46 of the retarding device 44 to raise to their inoperative position.

The differential pressure switch 164 connected across the screen of the battery condenser 10 can be used in applications other than as described above. It can be used to control the water pump 60 of a humidifying unit 28 where the humid air is applied in prior processes in the cotton gin plant. It can also be used to energize the water solenoid valve where liquid water is sprayed on the batt in the lint slide.

As can be readily understood from the above description and from the drawings, the present invention permits cotton to be humidified in an efficient and easily controllable manner so as to prevent the baling of dry cotton and the subsequent difficulties which accompany such baling. Further, the general efficiency of the baling operation is greatly improved in the process.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A Apparatus for humidifying lint cotton in a cotton gin, comprising, in combination:

(a) conveyor means for receiving material and controlling the movement of the material along a path of travel;

(b) exchanger means disposed on the conveyor means in the path of travel of the material for subjecting the material to a treating fluid; and (c) the conveyor means including retarder means for holding the material on the exchanger means for a predetermined period of exposure to the treating fluid, the exchanger means including, in combination:

(1) grid means arranged on the conveyor means for forming a part of the path of travel of the material; and (2) diffuser means arranged on the conveyor means beneath the grid means for passing the fluid through the grid means.

2. Apparatus for humidifying lint cotton in a cotton gin, comprising, in combination:

(a) conveyor means for receiving material and controlling the movement of the material along a path of travel; and (b) exchanger means disposed on the conveyor means in the path of travel of the material for subjecting the material to a treating fluid, the exchanger means including, in combination:

(1) grid means arranged on the conveyor means for forming a part of the path of travel of the material; and (2) diffuser means arranged on the conveyor means beneath the grid means for passing the fluid through the grid means, with the conveyor means including a downwardly inclined slide having a longitudinally extending substantially planar bottom surface provided with a width, with the grid means including a plurality of tubular members disposed extending longitudinally of the extent of the bottom surface of the slide and spaced therefrom, the tubular members being disposed in spaced side-by-side relation across substantially the entire width of the bottom surface of the slide.

3. Apparatus for humidifying lint cotton in a cotton gin, comprising, in combination:

(a) conveyor means for receiving material and controlling the movement of the material along a path of travel; and (b) exchanger means disposed on the conveyor means in the path of travel of the material for subjecting the material to a treating fluid, the exchanger means including, in combination:

(1) grid means arranged on the conveyor means for forming a part of the path of travel of the material; and (2) diffuser means arranged on the conveyor means beneath the grid means for passing the fluid through the grid means, the diffuser means including, in combination:

(i) transition means arranged receiving the treating fluid for spreading and reducing the velocity of the fluid; and (ii) a diffuser plate arranged receiving the fluid from the transition means and diffusing the fluid evenly beneath the exchanger means.

4. A structure as defined in claim 3, wherein the conveyor means includes retarder means for holding the material on the exchanger means for a predetermined period of exposure to the treating fluid.

5. A structure as defined in claim 4, wherein the retarder means includes, in combination:

(1) a finger element arranged biasing the material on the conveyor means; and (2) actuator means mounted on the conveyor means and connected to the finger element for exerting a predetermined torque on the finger element, the latter holding the flow of material until the force of the material on the finger element exceeds the predetermined torque and forces the finger element away from the material in order to permit continued flow of the material along the flow path of the conveyor means.

6. A structure as defined in claim 4, wherein a battery condenser feeds the conveyor means, a screen associated with the battery condenser, and further including regulator means for controlling the retarder means and the flow of treating fluid through the exchanger means as a function of a pressure differential across the condenser screen.

* * * * *